United States Patent [19]

Roberts et al.

[11] 4,031,675

[45] June 28, 1977

[54] FREE STANDING REDECORATABLE VERTICAL WALL OR DIVIDER

[76] Inventors: Raymond P. Roberts, 5909 E. 58th Place; Sven Arthur John Nilson, Jr., 5328 S. Toledo, both of Tulsa, Okla. 74135

[22] Filed: Feb. 26, 1976

[21] Appl. No.: 661,736

Related U.S. Application Data

[63] Continuation-in-part of Ser. No. 581,740, May 29, 1975, abandoned.

[52] U.S. Cl. ..... 52/36; 52/122; 52/221; 52/241; 52/127; 52/586

[51] Int. Cl.[2] ..... E04B 2/74

[58] Field of Search ..... 52/586, 238, 239, 241, 52/243, 122, 127, 242; 160/135, 350, 351

[56] References Cited

UNITED STATES PATENTS

| | | | |
|---|---|---|---|
| 2,787,812 | 4/1957 | Long | 52/586 |
| 3,075,253 | 1/1963 | Hammitt | 52/586 |
| 3,508,364 | 4/1970 | Thompson | 52/122 |
| 3,699,734 | 10/1972 | Craig | 52/241 |

*Primary Examiner*—John E. Murtagh
*Attorney, Agent, or Firm*—Head, Johnson & Chafin

[57] ABSTRACT

A free-standing fabricatable vertical wall or space divider is useful for partitioning buildings and/or office complexes. The wall is made up of a plurality of individualized and decorative flush panel units which are interchangeable and which are adapted to be readily inserted within a wall frame and locked into place without any visual showing of vertical supports used to lock the panels in place. The panels may be removed, redecorated and replaced as needed. Shelving or other appurtenances are attachable to the hidden vertical supports. The entire wall panel and/or divider is capable of replacement when it is desired to rearrange or enlarge or change a given floor space. Identical walls or dividers of the same basic construction are transversely connectable to each other.

28 Claims, 20 Drawing Figures

FREE STANDING REDECORATABLE VERTICAL WALL OR DIVIDER

CROSS-REFERENCE

This is a continuation-in-part of Copending Application Ser. No. 581,740 filed May 29, 1975 now abandoned.

BACKGROUND OF THE INVENTION

This invention is in the field of movable wall panels and space dividers which may be made to conform and fit a desired functional usage. There are in the prior art many types of wall panels and designs useful in designing and arranging floor plans for buildings to meet various functional needs of offices, homes or the like.

Typical of such prior art is that shown in the following patent references:

| U.S. Pat. Nos. | | |
|---|---|---|
| 1,154,622 | 2,730,209 | 2,787,812 |
| 2,832,101 | 3,694,975 | 3,713,257 |
| 3,049,197 | 3,492,766 | 3,429,601 |
| 3,488,908 | 3,852,926 | 2,107,624 |
| 3,299,594 | 3,075,253 | 2,371,300 |
| 3,194,361 | 3,377,756 | 3,643,395 |
| Great Britain Patents Nos. | | |
| 179,840 (1922) 197,184 (1923) | | |
| Italy Patent No. 553,280 (1956) | | |
| Sweden Patent No. 129,429 (1950) | | |

These movable walls and dividers are of such construction, however, that they are not adaptable to quick assembly or to new and changing material and design concepts for decorating or redecorating. In addition, the prior known wall panels are burdensome to assemble and, in some instances, do not provide sufficient separations of office functions to prevent noise or other distracting influences from the next adjacent areas, and do not have the appearance of a permanent wall.

SUMMARY OF THE INVENTION

This invention has for its object to provide a free standing wall or vertical divider which is capable of placement within any building complex to form cubicles or areas for different functional purposes in accordance with a desired floor plan.

The invention permits the utilization of identically pre-constructed elements such as frames and panels which can be quickly assembled in desired patterns of functional usage in building spaces, and which can be readily moved with changes in floor plan or decor.

Generally the invention is directed to a free-standing vertical divider wall useful in separating or dividing areas, especially within buildings, to form offices, classrooms and the like. The structure of the invention basically incorporates a quadrilateral frame, of desired thickness, the inside space defined by the frame being filled with one or more decorative panels. First vertical support members of thickness less than the thickness of the frame extend internally along each of the inside vertical frame sections. These first support members may be movable in a horizontal direction and include apertures for the placement of hidden locking devices, keepers or brackets for the support of shelves or other appurtenances. If a plurality of panels are used, there is at least one second vertical support member positioned to the upper and lower horizontal frame sections so as to be movable in a horizontal direction yet retained to the upper and lower horizontal frame sections. The vertical second support members divide the space horizontally between the first supports being movable to permit a plurality of panels to substantially fill the divided space inside the frame. The panels have grooves or recesses along their vertical edges into which the support members are caused to operate and thus permit the insertion of each of the panels. The second vertical support members are then moved to a mid-position relative to the edges of adjacent panels and temporarily locked in place by hidden keeper members inserted into apertures in the support members. Each of the panels includes a resilient peripheral edge that, in essence, makes the panel slightly larger than the space it is to fill, thus being compressible to the actual dimensional space when in place. Because of the resiliency, the aforementioned keepers and/or shelf brackets are readily insertable into apertures vertically formed in the support members. The bottom of the frame member may include a hollow box into which appropriate utility lines may be carried to appropriate outlets within the walls. Appropriate openings are provided, prior to insertion of the panel members, to level the framework in its desired position. Once the panels have been inserted these openings are unseen.

DETAILED DESCRIPTION

Before explaining the present invention in detail, it is to be understood that the invention is not limited in its application to the details of construction and arrangement of parts illustrated in the accompanying drawings, since the invention is capable of other embodiments and of being practiced or carried out in the various ways. Also, it is to be understood that the phraseology or terminology employed herein is for the purpose of description and not of limitation.

Figure 1:
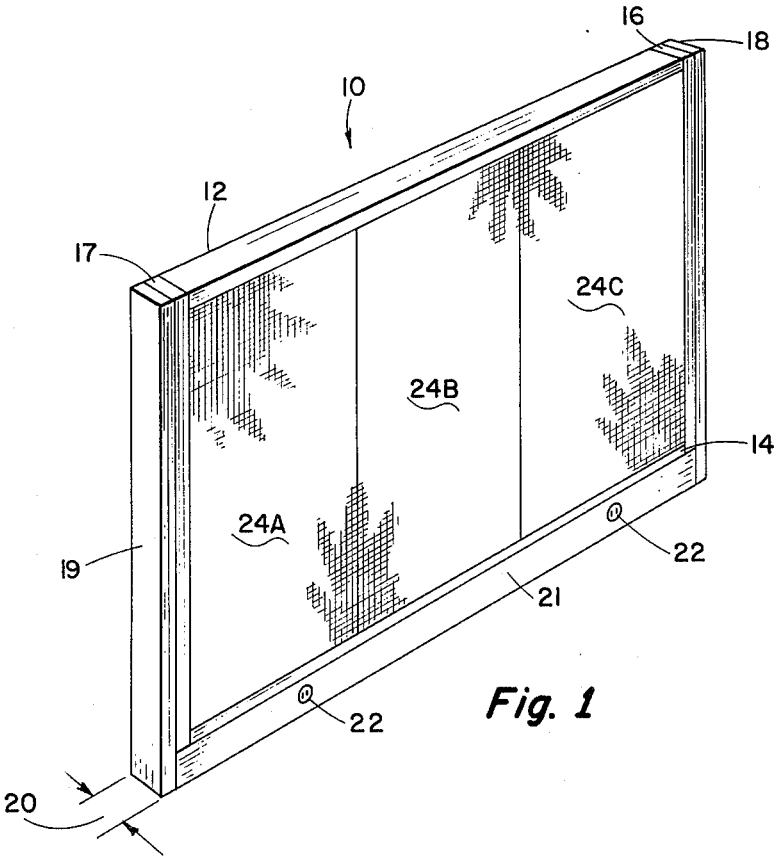
FIG. 1 is a perspective view of the wall or divider of this invention.

Referring now to the drawings, where like numbers are used for like elements throughout and, in particular, reference is made to FIG. 1 wherein the wall or divider unit of this invention is generally indicated by the numeral 10. The wall generally comprises a basic frame having upper and lower horizontal members 12 and 14 and vertical members 16 and 17. Additional vertical structural members 18 and 19 may be made a part of the frame as shown. The frame will be made of a desired wall thickness 20. In one embodiment of the invention a basement box 21 extends below the lower horizontal frame 14 and is adapted to contain levelling legs and utility lines, e.g., telephone, electricity, or fluids, not shown in this view. Appropriate outlets 22 are provided for connection therewith. The box, in another embodiment may be made a part of the other frame members with the same functional usage. Interiorly of the frame and described in greater detail hereafter are a plurality of decorative panel units designated 24A, 24B and 24C.

Figure 2:
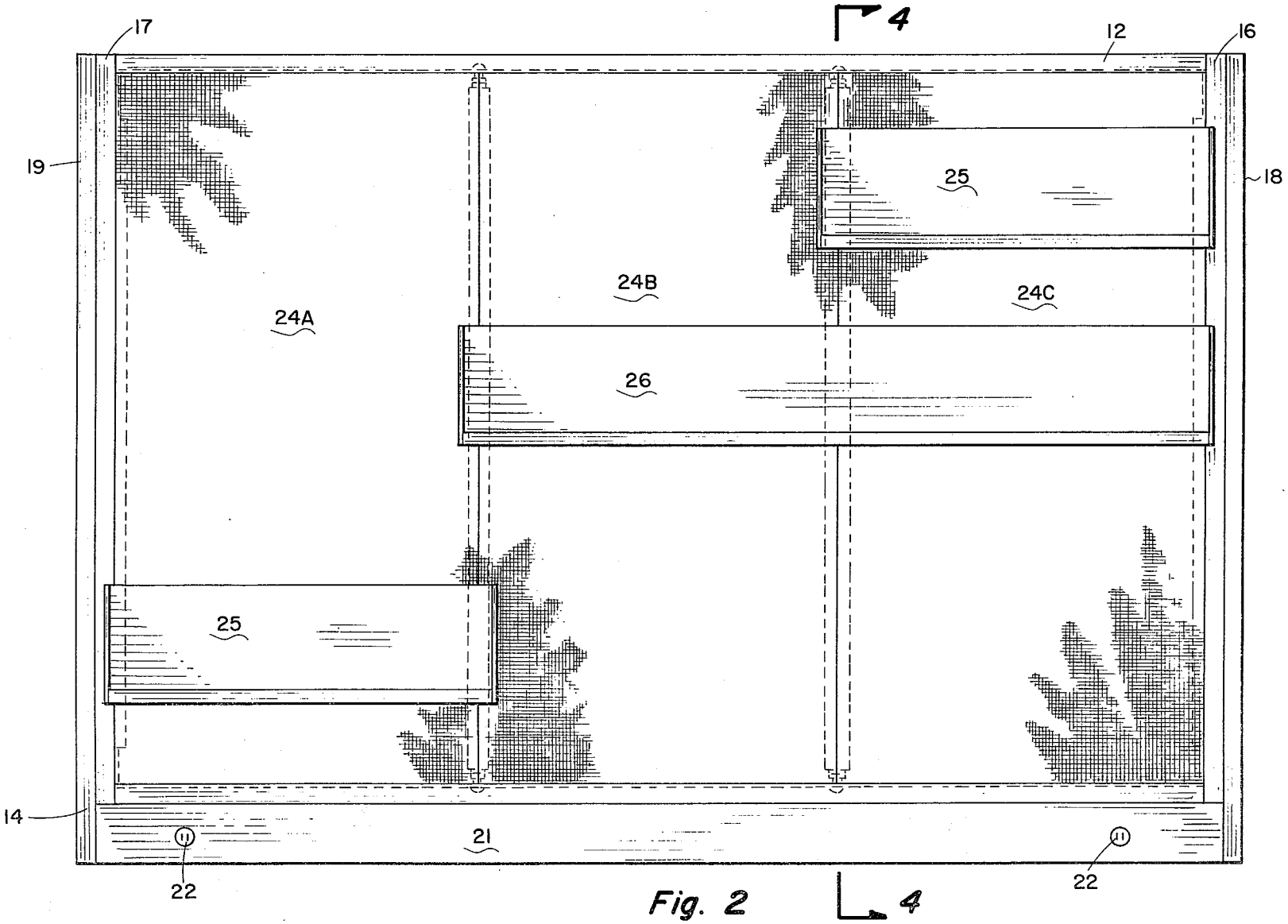
FIG. 2 is a front elevational view of the wall or divider of this invention, including shelves supported thereon.

In the front elevational view of FIG. 2 shelves 25 and 26 are shown as they would be hung on the wall of this invention, in manners hereinafter described. As shown the wall is assembled in such a manner that only the outer frame members 12, 14, 16, 17, 18, 19 and 21, and the desired ornamental replaceable panels 24A, 24B and 24C are exposed to view, with the internal structural members substantially hidden as shown by the dotted lines. As such a novel wall is provided wherein the panels substantially fill the space within the defined frame, yet are easily assembled, removed or replaced as hereinafter described.

Figure 3:
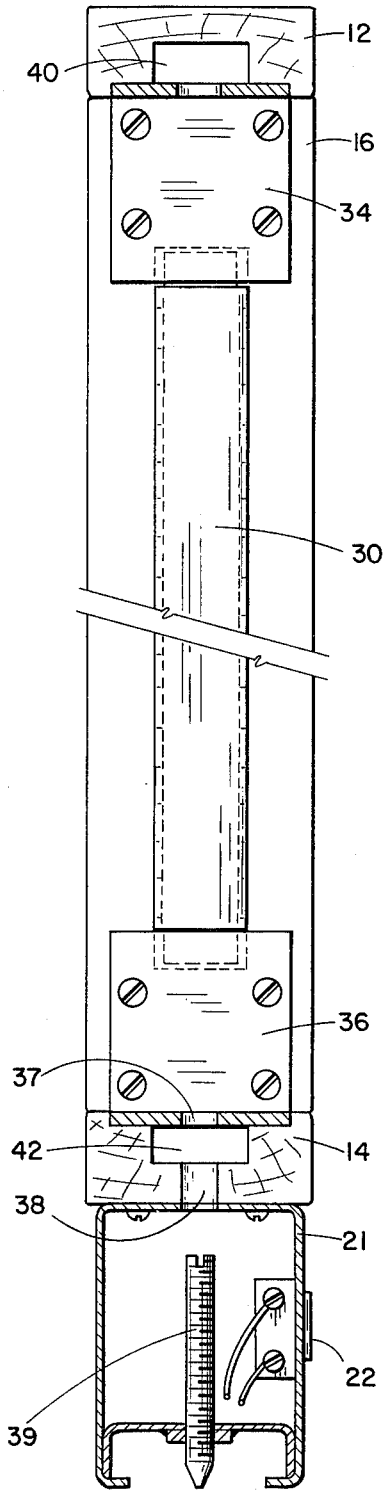
FIG. 3 is a side sectional view taken along the line 3—3 of FIG. 8.

The internal structural members are described in reference to FIGS. 3, 4, 5 and 6. FIG. 3 is the right-hand side while a mirror image thereof will comprise the left-hand side.

The inner end framework includes first tubular support members 30, which are of a thickness less than the thickness 20 of the frame. These first support members 30 are vertically positioned to the inside of said frame within a vertical recess 32 within the respective vertical frames 16 and 17. The member includes a plurality of vertically aligned apertures 31. The vertical first support members are movable in a horizontal direction being retained within their recessed 32 by upper and lower corner plates 34 and 36 which are attached to frames 16 and 17. (See FIG. 10) The frontal width of said first support members is designated as X.

Figure 4:
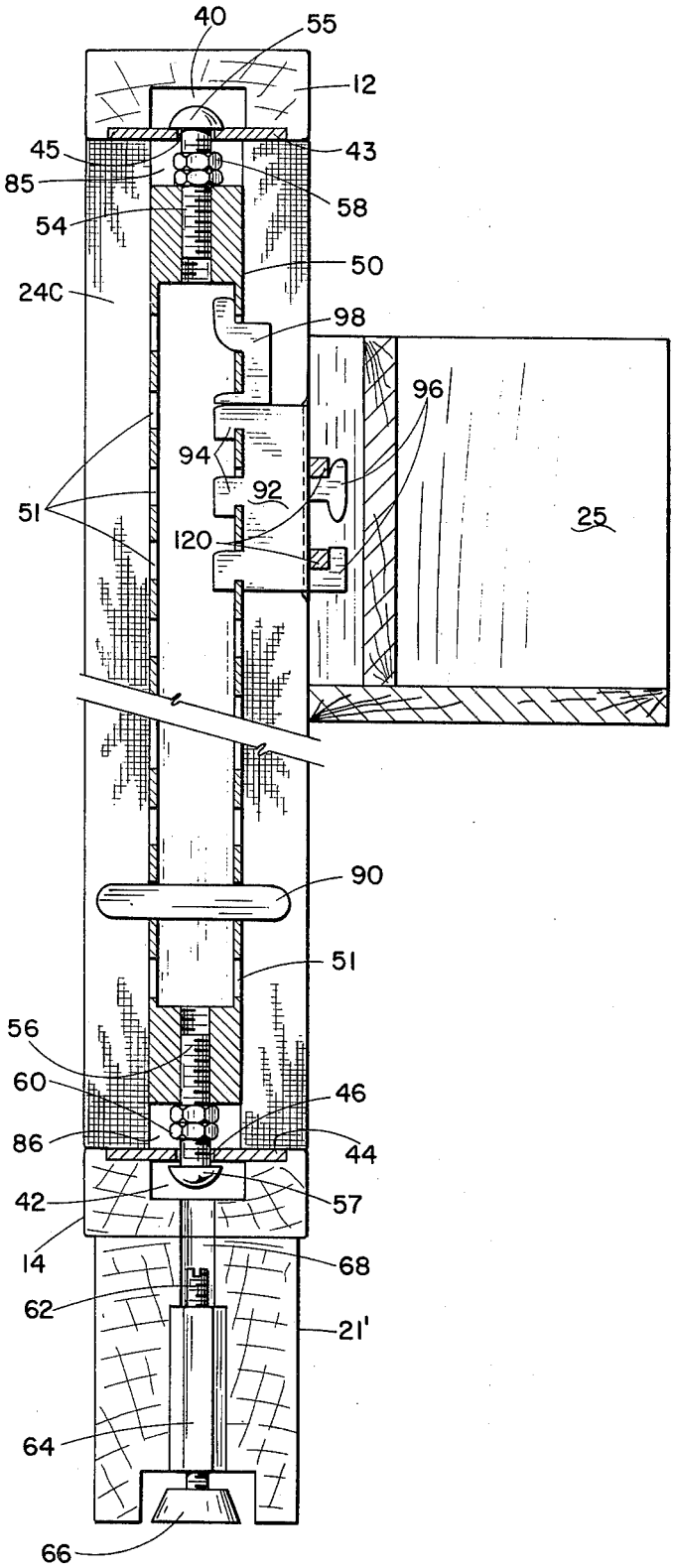
FIG. 4 is a side sectional view taken along the line 4—4 of FIG. 2.
Figure 13:
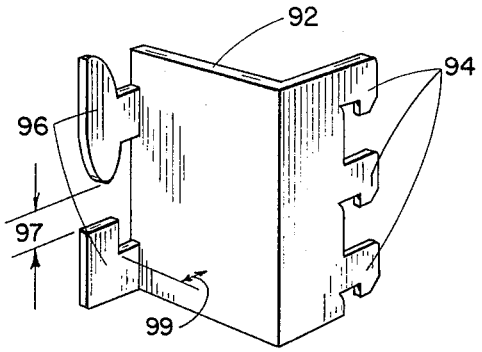
FIGS. 13 and 14 are perspective views of shelf support brackets.

As shown in FIG. 3 the horizontal leg of said lower corner plates include opening 37 aligned with opening 38 of the base frame to permit a tool to engage levelling screw 39 which may include a foot pad as shown in FIG. 4. The upper and lower horizontal frames include respective recesses 40 and 42 particularly described hereafter relative to the secondary support members.

Figure 5:
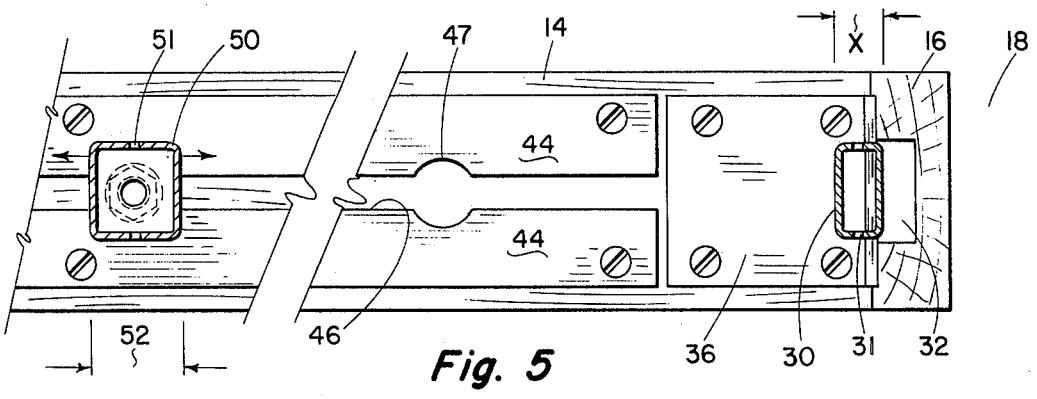
FIG. 5 is a sectional view taken along the line 5—5 of FIG. 8.

Cover plates 43 and 44 comprise identical members or strips which cover respective recesses 40 and 42 being attached to respective frame members 12 and 14 as shown in FIGS. 4 and 5 yet spaced to create therebetween upper and lower guide slots 45 and 46 with enlarged openings 47 (Shown in FIG. 5)

Intermediate the frame members 16 and 17 is at least one second vertical support member 50, each having a plurality of vertically aligned apertures 51 such as universal slots capable of accepting universal fixtures. In the embodiments shown two of such members are necessary. These vertical supports are preferably made of rectangular or square tubing of a dimension less than the thickness of the frame (preferably equal to the thickness of the first support members 30 and have a frontal width 52 which is no greater than twice the width (2X) of a first support member. Each of the second support members 50 are identical in construction and include upper and lower bolts 54 and 56 threaded to the respective top and bottom support member 50 and which operate within appropriate and respective upper and lower guide slots 45 and 46. The respective bolt heads 55 and 57 are insertable in one or more enlarged openings, as 47 in FIG. 5, of the cover plates. Lock nuts 58 and 60 retain the bolts fixed in position. The second vertical support members are adapted for horizontal sliding movement (See arrows in FIGS. 5 and 11) either side of a division line (e.g., one-half, one-third as shown, etc.) between the interior space formed by frame members 12, 14, 16 and 17. In the embodiment shown, this space is divided into three equal spaces.

The base member 21' in FIG. 4 is to show another embodiment including levelling screw 62, associated nut 64, and a foot pad 66 formed as a part of the screw. Suitable openings 68 are provided for screwdriver or other tool to permit adjustment through the lower frame 14. The openings in all embodiments are fully hidden from view when the panels 24 are in place and may have temporary dust covers as desired and not shown.

Figure 6:
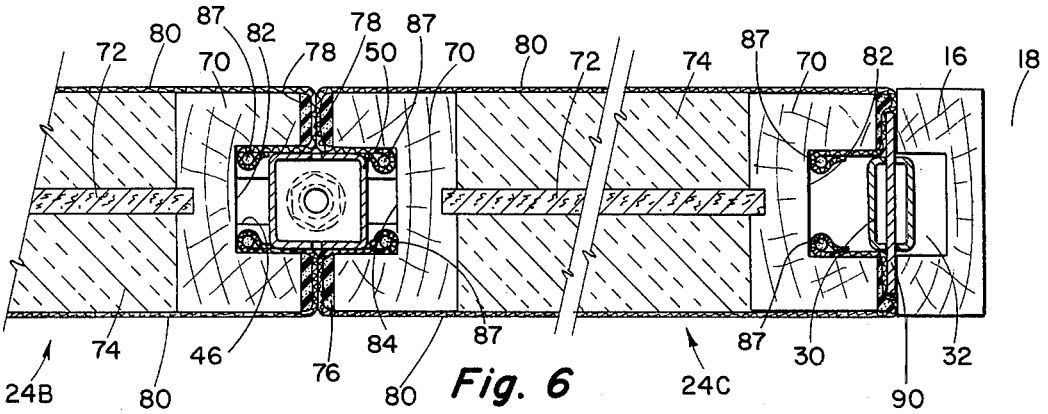
FIG. 6 is a sectional view along the lines 6—6 of FIG. 10.

Panel members 24A, 24B and 24C are identically constructed. In this embodiment, as shown in FIG. 6, the panels describe a basic quadrilateral framework 70 interconnected by a central plate 72. Suitable filler 74, e.g. acoustic or other insulation materials is received between the frame structure 70 and 72. Around the outer periphery of frame 70 are strips of resilient material (e.g., sponge rubber, vinyl or soft plastics) 76 and 78. Preferably the strips increase the outer peripheral dimension of the frame slightly greater than the frame opening to receive the panel. Thus, the panels are compressibly retained to each other and the frame members without further movement but yet will permit the panels to be readily inserted and removed. Covering the framework is fabric 80. It is to be understood, however, that the outer covering may be any decorative material, albeit wood, fabric, masonry, or other decorative designs and materials, all of which are within the purview of this invention and dictated by an interior designer's skill. The framework of panels is adapted to substantially fill each of the horizontally divided areas inside the frame. Each of the panels includes vertical grooves 82 and 84 on each side thereof, each of the grooves being of a thickness slightly larger than the thickness of the vertical support members but having a frontal width that is no less than the frontal width of the second support members 50.

The support members 50 are movable either side of the imaginary division line for each space for a distance equal to at least the width 52 of said second vertical supports. Although grooves 85 and 86 are shown in the upper and lower horizontal portions of the panel frames 70 (See FIG. 4) this is not absolutely necessary (e.g., see FIG. 16).

Figure 20:
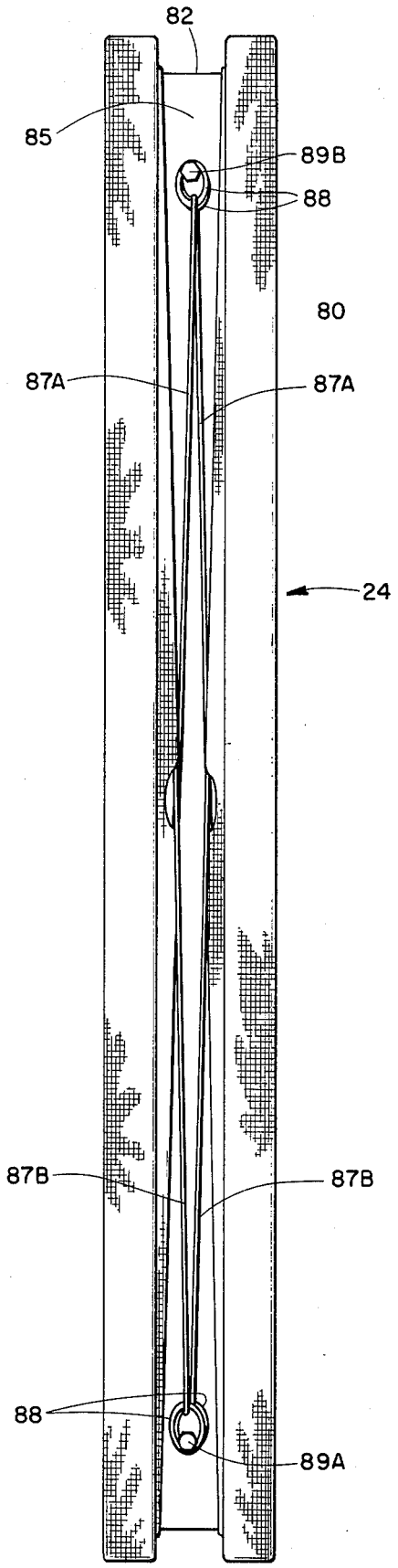
FIG. 20 is a top elevational view depicting the drawstring means to lock fabric type cover panels in place.

The horizontal basement box portion 21 is adapted to receive, as best shown in FIG. 3, appropriate utility (telephone and electrical, communication, and fluid) which are adapted to be connected to suitable outlets 22. Connections are made to utility usages within the panels for other appurtenances attached therewith, e.g., as shown in FIG. 20. Conduit means is provided in the panel, e.g., via the vertical grooves 82 and 84 or through the vertical support members 30 and/or 50.

Figure 14:
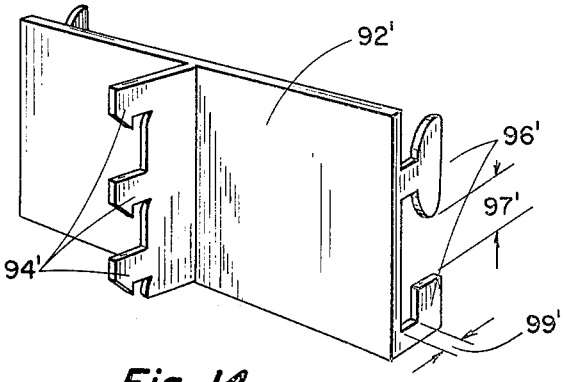
Figure 15:
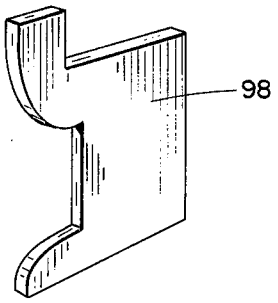
FIG. 15 is a perspective view of a shelf bracket keeper.
Figure 12:
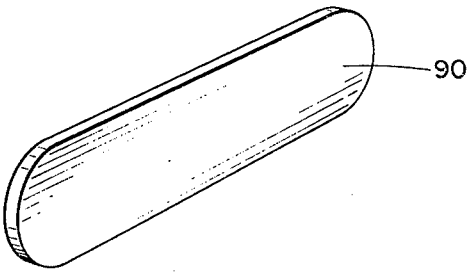
FIG. 12 is a perspective view of a panel locking and alignment member.
Figure 7:
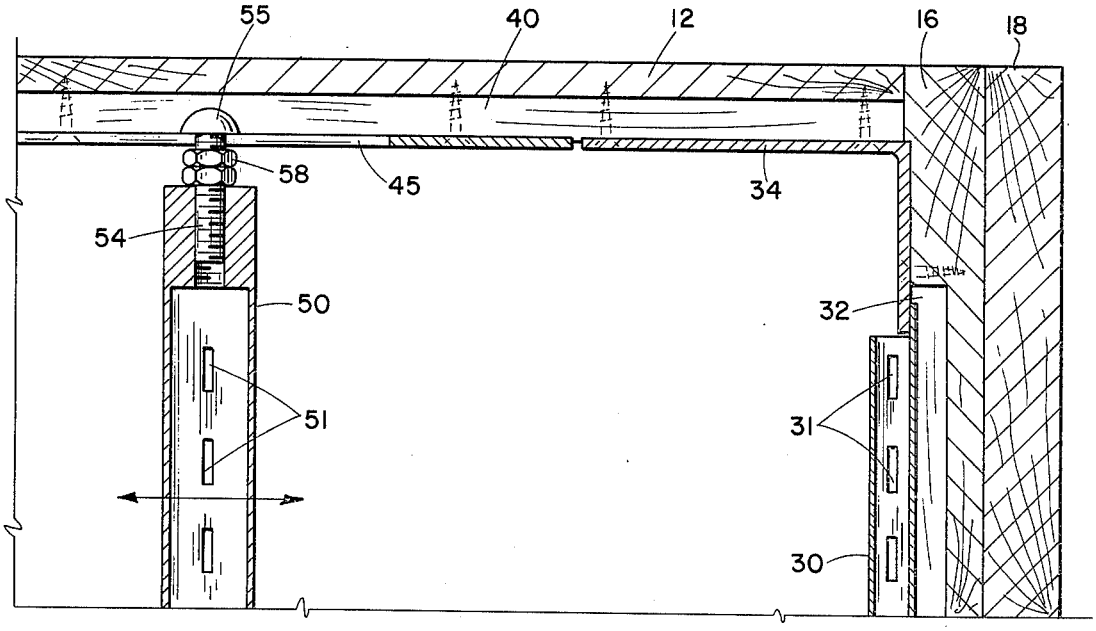
FIG. 7 is a partial sectional frontal view of a corner wall frame construction without panels.

FIGS. 12, 13, 14 and 15 describe typical devices for attachment to the apertures in vertical supports 30 and 50. Keeper 90 is used to retain the vertical supports in the assembled position relative to panels 24 and are insertable through aligned apertures 31 or 51 as necessary. Shelf bracket 92 includes support mounting clips 94 for insertion within the apertures 31 or 51 between adjacent panels 24. Shelf 25 or other apurtenances are attached to shelf mounting clips 96 as shown in FIG. 4. The shelf clips comprise upper and lower parts spaced a distance 97 and 97′ slightly larger than the vertical dimension of the lower shelf rod 120. Grooves 99 and 99′ in both upper and lower parts are slightly larger than the horizontal dimension of the shelf rods. The upper part is rounded as shown while the lower part is square cut. The spacings prevent the shelf rods from coming out of the clips if accidentally raised vertically. FIG. 14 describes a bracket 92 that will straddle a panel joint. In FIG. 15 a locking keeper 98 is depicted as being used to prevent vertical movement of the bracket 92 as shown in FIG. 4.

OPERATION

Figure 8:
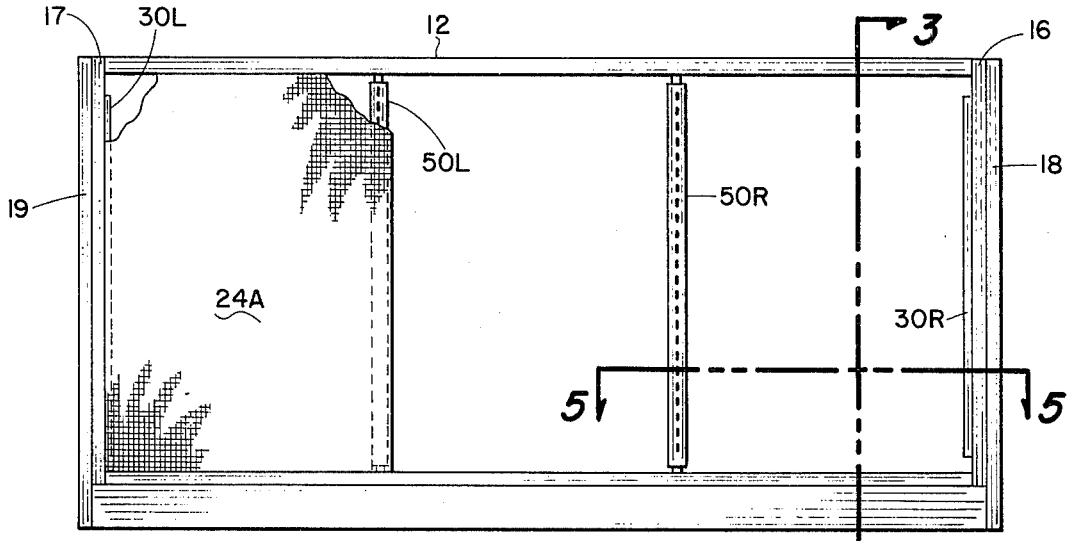
FIGS. 8, 9 and 10 are front elevational views showing the method of assembling a three-panel wall or divider of this invention.
Figure 9:
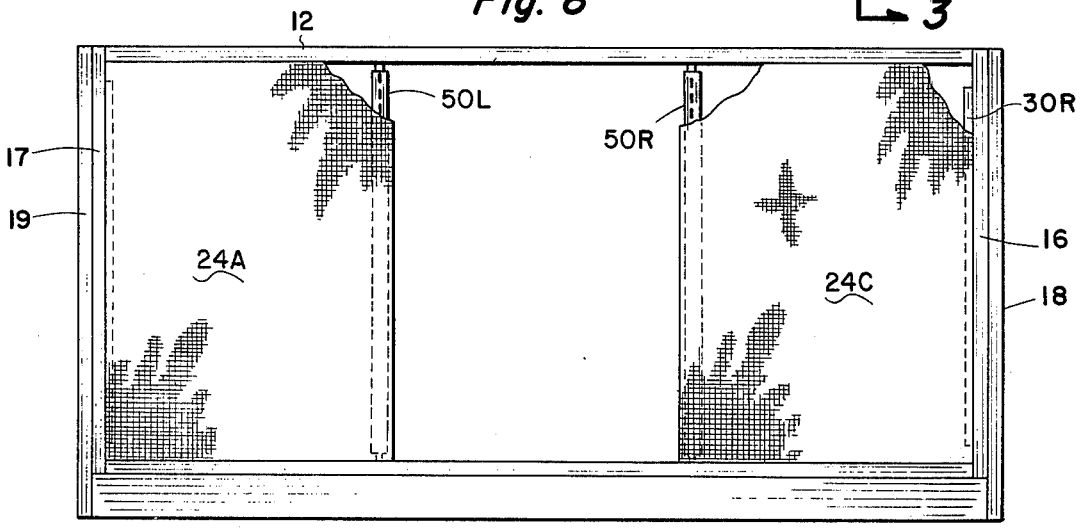
Figure 10:
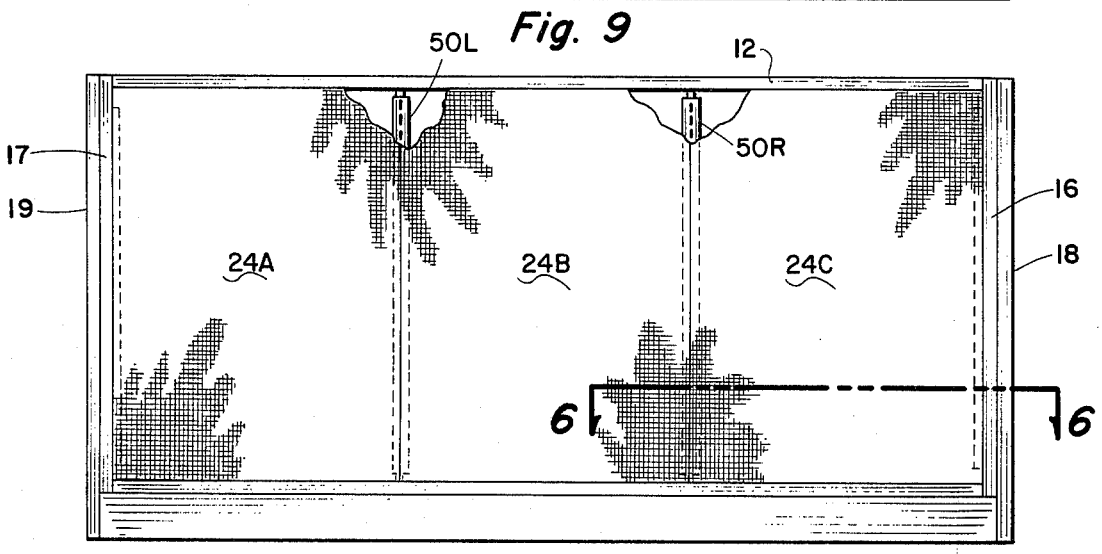

Referring now to FIGS. 8, 9 and 10, a typical operation is shown for constructing the wall and/or divider of this invention. A first panel unit 24A is placed into position as shown by first moving a second support member 50L to its extreme position to the right of its imaginary division line. The wall panel 24A is then placed such that its vertical groove 84 will straddle the first vertical support, designated 30L in these views. In the event said first vertical support 30L is movable, further locking of the panel is achieved by moving same to the right to straddle the panel groove 84. One or more keepers 90 are inserted into the support apertures 31 between the left edge of panel 24A and frame 17. Thereafter the movable support 50L is then moved horizontally to the left into the appropriate groove 82 of the panel 24A. As a second step a similar procedure occurs on the right hand side of the wall of this invention by moving the support 50R to the left of its center division inserting the panel 24C such that its vertical groove 82 straddles the first support member 30R. If member 30R is movable, then it may be moved to the left to lock panel 24C in place using keepers 90. Thereafter second support 50R is moved to the right of its imaginary division line so as to be enclosed within the groove 84 of the panel 24C. In this position, as shown in FIG. 9, the third panel 24B may then be inserted into the space provided. Thereafter an appropriate spatula or thin blade-like tool or instrument is placed between the panels and the frame to move the second supports 50L and 50R to the right and to the left, respectively, so as to be centered at the panel division line as shown in FIG. 10, thus locking the panels with keepers 90 or shelf brackets 92 in ultimate desired position.

Openings 31 and 51 at parallel locations on the other supports are adapted to receive brackets 92 or 92′ appropriately placed by the insertion of clips 94 or 94′ between the panels or panel and frames in the matching apertures to the position shown in FIG. 4. Shelf clips 96 or 96′ are adapted to receive, retain and support shelf units as generally indicated by the numerals 25 and 26. Horizontal rods 120 are adapted to fit, lock, and be retained by the retaining clips 96 or 96′. The bracket 92 or 92′ is then locked into place so as not to be movable vertically by keeper 98 positioned above the bracket 92 in the manner shown.

MODIFICATIONS

Figure 11:
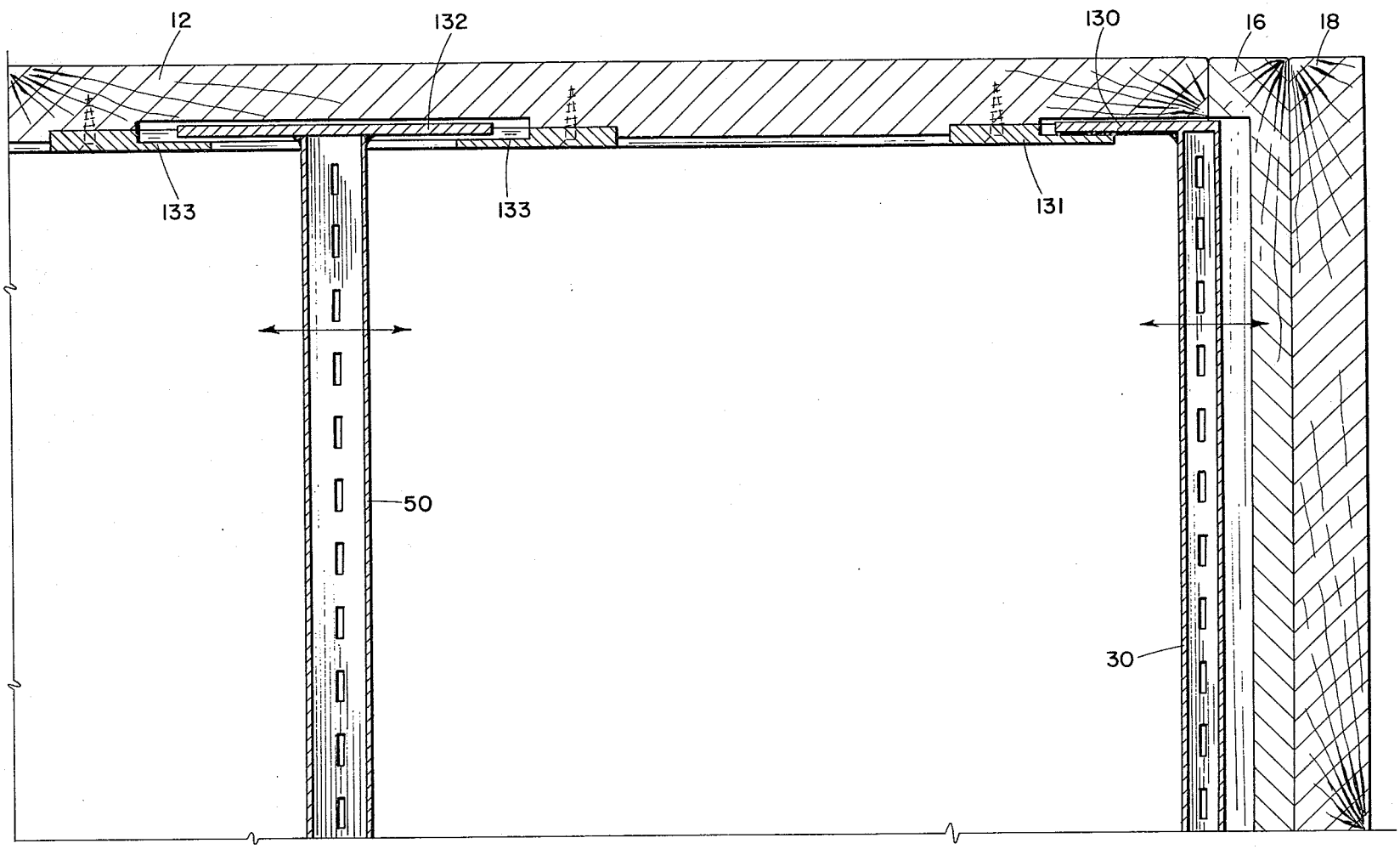
FIG. 11 is a partial sectional frontal view of an alternate construction for retaining vertical wall supports used in the invention.

FIG. 11 described a modified vertical support construction. Vertical supports 30 and 50 include respective upper and lower L and T sections 130 and 132 movable in appropriated recesses covered by respective plates 131 and 133.

Figure 17:
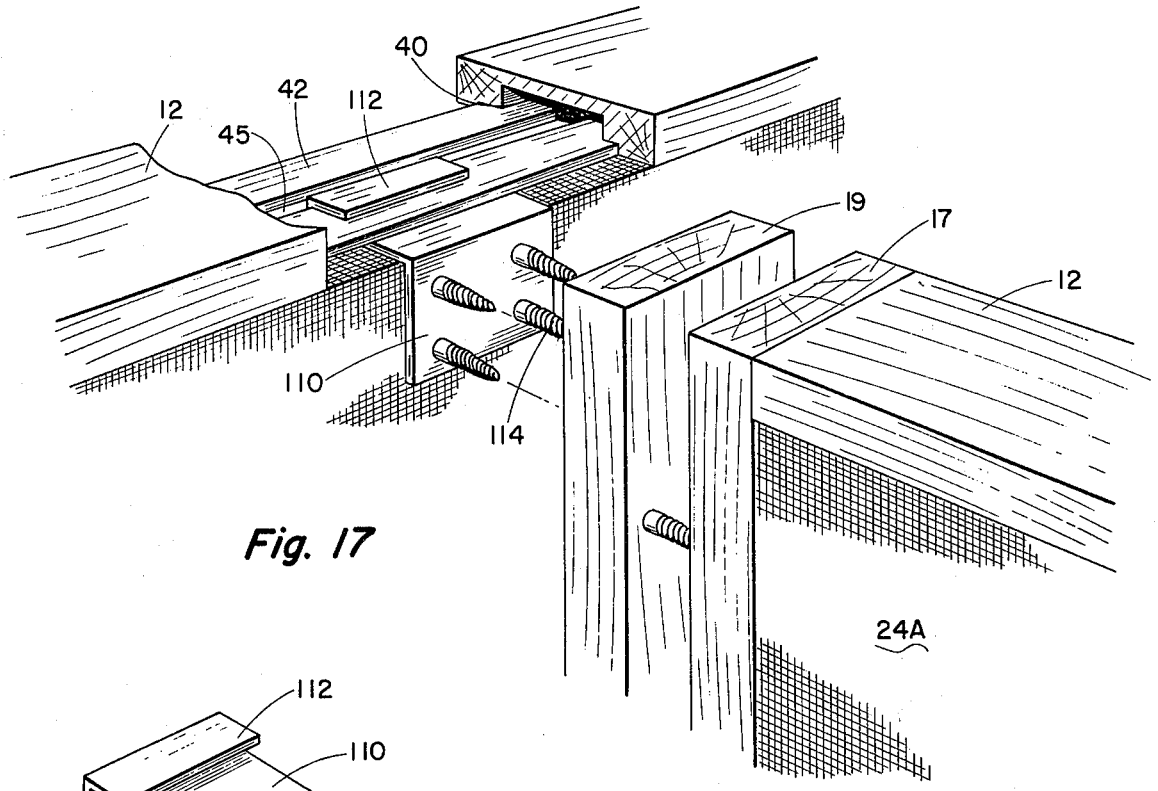
FIG. 17 is an exploded perspective view of FIG. 16.
Figure 18:
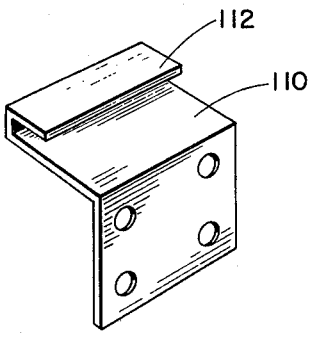
FIG. 18 is a perspective view of a bracket used in the connections shown in FIGS. 16 and 17.
Figure 16:
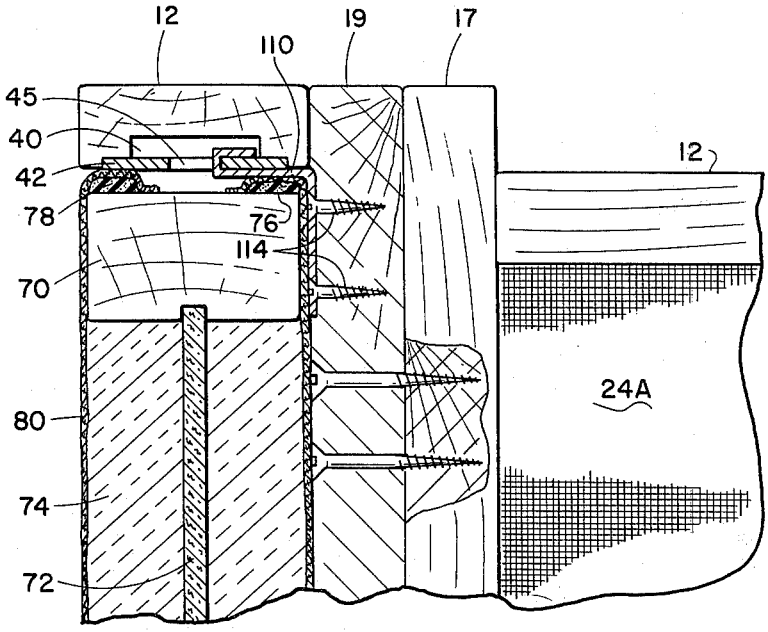
FIG. 16 is a partial side sectional view depicting means to attach transverse walls or dividers together.

FIGS. 16, 17 and 18 describe means whereby one or more second walls can be attached transversely or angularly to a first wall or divider. A transverse wall bracket 110 includes a lip 112 insertable in upper and lower guide slots 45 and 46 while panel 24 is removed. Fasteners 114 are used to connect to the transverse wall frame 19. The panel of the first frame may be placed and the operation of assembly for the transverse panel commences as described. The panel of the transverse frame may be of different height as shown.

Figure 19:
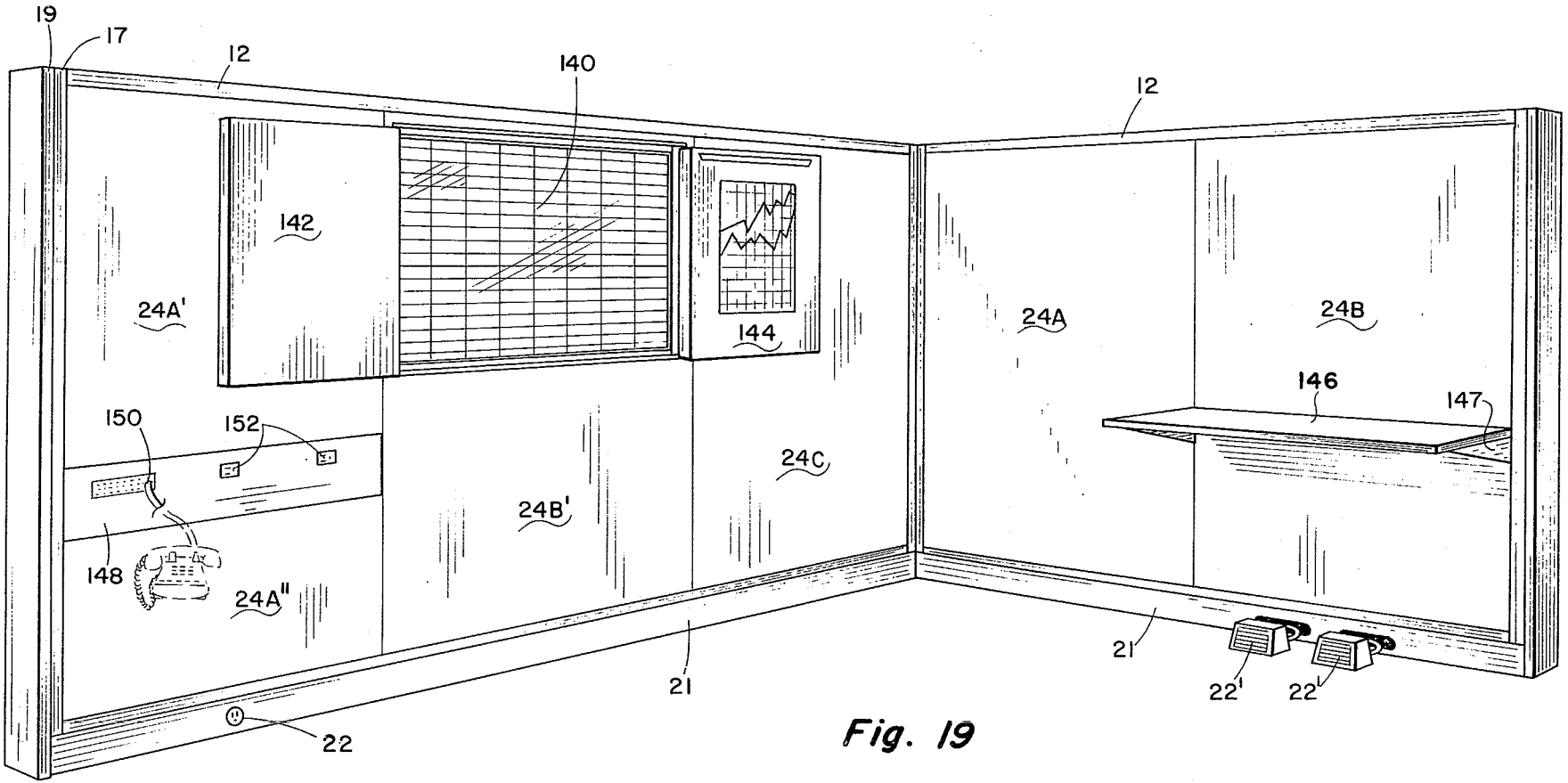
FIG. 19 is a perspective view of a modified panel embodiment.

FIG. 19 depicts an assembly view of a typical office or room cubicle formed with the walls or dividers of this invention as may be modified for different functional purposes. As shown a two-panel unit is transversely attached to a three-panel unit at the corners thereof in distinction to the construction of FIGS. 16 and 17. One of the panels is divided horizontally to include an audio-visual panel insert 140 which is coverable by hinged doors 142 and 144. Panel 24B would be thus modified. The panels could be divided vertically too. A general utility shelf or credenza 146 (glass or wood) is also shown attached to the two-panel wall using universal shelf brackets 147. Typically, ½ inch long slots are spaced 1 inch center to center. An insertable panel 148 modifies panel 24A′ into three sections. Panel 148 providing further means to connect with utility line needs such as means 150 to connect with a telephone, for example, or other needs to eliminate exposed lines from the floor connectors 22. The wall is also readily adaptable to connect with utility line connectors from floor connectors 22′ as shown or to outlets 152 above the floor in panel 148.

When using a fabric panel member 80 one means for readily removing same for cleaning or changing is with a drawcord 87 and 88 formed in the outer peripheral edge. FIG. 20 depicts a preferred manner of attaching the rings 88 of drawstring ends 87A and 87B of a fabric panel 80 to the screw heads 89 in the recess groove 85.

Although a plurality of panels 24 have been shown the concepts of the invention include a single panel design omitting the need for a secondary divisional support 50, but utilizing movable first supports 30 in the vertical end.

What is claimed is:

1. A free-standing vertical divider wall comprising:

a frame having horizontal and vertical sections of desired thickness defining a panel receiving space;

first support members, each of thickness less than the thickness of said frame and of frontal width X, and extenable into a grooved space of the frame along each of the inside vertical sections of said frame;

at least one second support member of thickness less than the thickness of said frame and of frontal width no greater than 2X, said second support vertically positioned between said horizontal sections to substantially divide the space horizontally between said first supports, said second support being movable horizontally either side of said division position a distance of at least equal to the width of said second support;

said first and second support members having a plurality of spaced apertures along their frontal width, a panel for each horizontally divided space inside said frame, each of said panels having grooves hidden between front and back sides of said panel along each vertical edge, said grooves of thickness slightly larger than the thickness of said support members and of frontal width no less than the frontal width of said second support, a resilient pad around the outermost peripheral edges of each of said panels and a covering about said panel and pad whereby when in place, with each panel substantially filling each divided space, said support members and apertures are not in view yet access is available to said support members or to said apertures by resilient compression of the outer periphery of said pad.

2. The wall of claim 1, including above or below said frame a hollow box for utility lines, and suitable means supported by said box to connect with said utility lines.

3. The wall of claim 1, wherein said covering is removable.

4. The wall of claim 1, including means in contact with a floor at the bottom horizontal section of said frame and interiorly thereof to level said frame to said floor.

5. The wall of claim 2 wherein said box is at the bottom of said frame means, interiorly thereof, to level said wall, and access means through the bottom of said frame to reach and adjust said levelling means.

6. The wall of claim 1 wherein one of said panel members is horizontally divided.

7. The wall of claim 6 wherein one of said divided panels includes an audio-visual means.

8. The wall of claim 6 wherein one of said divided panels includes utility outlets.

9. A free standing vertical divider wall comprising:

a frame having horizontal and vertical sections of desired thickness and defining a panel receiving space;

first vertical support members each of thickness less than the thickness of said frame fixed to and extending into the frame along each of the inside vertical sections of said frame;

at least one second support member of thickness less than the thickness of said frame and vertically positioned between said horizontal sections to substantially divide the space horizontally between said first supports, said second support being movable horizontally either side of said division line a distance equal to the width of said second support;

said first and second support members having a plurality of spaced apertures along their frontal width, a panel for each horizontally divided space inside said frame, each of said panels having grooves hidden between front and back sides of said panel along each vertical edge, said grooves of thickness slightly larger than the thickness of said support members and of frontal width no less than the frontal width of said second supports, a resilient pad around the outermost peripheral edges of each of said panels and a covering about said panel and pad whereby when in place, with each panel substantially filling each divided space, said support members and apertures are not in view yet access is available to said support members or to said apertures by resilient compression of the outer periphery of said pad.

10. The wall of claim 9, including above or below said frame a hollow box for utility lines, and suitable means supported by said box to connect with said utility lines.

11. The wall of claim 9, wherein said covering is removable.

12. The wall of claim 9, including means in contact with a floor at the bottom horizontal section of said frame and interiorly thereof to level said frame to said floor.

13. The wall of claim 10 wherein said box is at the bottom of said frame means, interiorly thereof, to level said wall, and access means through the bottom of said frame to reach and adjust said levelling means.

14. A free standing vertical divider wall comprising:

a quadrilateral frame of desired thickness having upper and lower horizontal frame members attached to right and left vertical frame members to define a panel receiving locus;

a plurality of panels being disposed in abutting lateral juxtaposition with each other and said vertical frame members substantially to fill said panel receiving locus and present front and rear surfaces;

means presented from said vertical frame members securingly to engage said panels;

said juxtaposed panels having resilient pad means at their abutting vertical edges with opposed grooves hidden between the front and rear surfaces of said panels;

a vertical support having finite lateral width and being received within said opposed grooves to support said panels and being itself supported from the upper and lower horizontal frame members for movement laterally of the panel receiving locus within said frame;

the groove within at least the edge of one said panel having a lateral depth at least equal to the finite lateral width of said vertical support;

a covering about said panel and pad whereby when in place, with each panel substantially filling each divided space, said support members are not in view yet access is available to laterally move said support members by resilient compression of the outer periphery of said pad.

15. A method of assembling a vertical wall comprising the steps of:

erecting a quadrilateral frame having upper and lower horizontal frame members attached to first and second lateral frame members;

presenting first and second support members from the corresponding lateral frame members;

laterally retracting the first support member into the first frame member;

positioning at least one wall panel within the quadrilateral frame so as to engage the second support member and to align with the first lateral frame member; and inserting a spatula-like member between the horizontal frame member and the panel which abuts the first lateral frame member to engage and laterally extend said first support member into securing engagement with said wall panel.

16. A method of assembling a vertical wall comprising the steps of:

erecting a quadrilateral frame having upper and lower horizontal frame members attached to first and second lateral frame members to define a panel receiving locus;

presenting a support member from each lateral frame member;

mounting at least one support means to extend vertically between the horizontal frame members and to move laterally therealong;

moving the support means most proximate to the first lateral frame member laterally away therefrom;

positioning a first wall panel within the receiving locus so as to engage the support member on the first lateral frame member and to align with the support means;

moving the support means toward and fully into the wall panel;

abuttingly positioning successive wall panels within the receiving locus from the second lateral frame member to fill the panel receiving locus; and inserting spatula-like member between the first wall panel and the horizontal frame members to engage and laterally to extend the support means partially from the first wall panel into the adjacent wall panel whereby to support both and complete the wall.

17. A free-standing vertical divider wall comprising:

a frame of desired thickness defining a panel receiving space;

first support members, each of thickness less than the thickness of said frame extendable into the frame a frontal width X along each of the inside vertical sections of said frame;

at least one second support member of thickness less than the thickness of said frame and of frontal width no greater than 2X, said second support vertically positioned to substantially divide the space horizontally between said first supports, said second support being movable horizontally either side of said division position a distance at least equal to the width of said second support;

said first and second support members include a plurality of equally spaced slit openings along said frontal width, and in combination therewith shelf support brackets, each of said brackets comprising first means extending outward of said panels to support said shelf, means to inerlock with said slits and be supported thereby, and a second means interlocking in said slits immediately above said first means whereby said first bracket will not move vertically out of said slits; and a plurality of panels to fill each horizontally divided space inside said frame, each of said panels having grooves hidden between the front and back sides of said panel along each vertical edge, said grooves of thickness slightly larger than the thickness of said support members and of frontal width no less than the frontal width of said second supports.

18. A free standing vertical divider wall comprising:

a frame of desired thickness;

first vertical support members each of thickness less than the thickness of said frame fixed to and extending into the frame along each of the inside vertical sections of said frame;

at least one second support member of thickness less than the thickness of said frame and vertically positioned to substantially divide the space horizontally between said first supports, said second support being movable horizontally either side of said division line a distance equal to the width of said second support;

said first and second support members include a plurality of equally spaced apertures along said frontal width, and in combination therewith shelf support brackets, each of said brackets comprising first means extending outward of said panels to support said shelf, means to interlock with said apertures and be supported thereby, and a second means interlocking in said apertures immediately above said first means and whereby said first bracket will not move vertically; and a plurality of panels to substantially fill each horizontally divided space inside said frame, each of said panels having grooves hidden between front and back sides of said panel along each vertical edge, said grooves of thickness slightly larger than the thickness of said support members and of frontal width no less than the frontal width of said second supports.

19. A free-standing vertical divider wall comprising:

a quadrilateral frame of desired thickness having upper and lower horizontal frame members attached to right and left vertical frame members;

first vertical supports each of thickness less than the thickness of said frame retained within recesses along each of the inside vertical members of said frame and horizontally movable from said recess to a position inside said frame exposing a frontal width X;

at least one second vertical support of thickness less than the thickness of said frame and of frontal width no greater than 2X, said second support vertically positioned to substantially divide the space horizontally between said first vertical supports, said second support being movable horizontally either side of said division line a distance equal to the width of said second support;

said first and second support members include a plurality of equally spaced slit openings along said frontal width, and in combination therewith shelf support brackets, each of said brackets comprising first means extending outward of said panels to support said shelf, means to interlock with said slits and be supported thereby, and a second means interlocking in said slits immediately above said first means whereby said first bracket will not move vertically out of said slits; and a plurality of panels to substantially fill each horizontally divided space inside said frame, each of said panels having grooves hidden between front and back sides of said panel along each vertical edge, said grooves of thickness slightly larger than the thickness of said support members and of frontal width no less than the frontal width of said second supports.

20. A free-standing vertical divider wall comprising:

a quadrilateral frame of desired thickness having upper and lower horizontal frame members attached to right and left vertical frame members;

first vertical supports each of thickness than the thickness of said frame retained within recesses along each of the inside vertical members of said frame and horizontally movable from said recess to a position inside said frame exposing a frontal width X;

said first supports include a plurality of vertically spaced apertures along their frontal width, keeper means, of length less than the thickness of said frame and insertable into said apertures between said panel and said right and left vertical frame members;

at least one second vertical support of thickness less than the thickness of said frame and of frontal width no greater than 2X, said second support vertically positioned to substantially divide the space horizontally between said first vertical supports, said second support being movable horizontally either side of said division line a distance equal to the width of said second support; and a plurality of panels to substantially fill each horizontally divided space inside said frame, each of said panels having grooves hidden between front and back sides of said panel along each vertical edge, said grooves of thickness slightly larger than the thickness of said support members and of frontal width no less than the frontal width of said second supports.

21. The wall of claim 20 wherein a plurality of panels are used and said second supports include a plurality of vertically spaced apertures along their frontal width, and additional keeper means are insertable into said apertures between said panels.

22. A free-standing vertical divider wall comprising:

a quadrilateral frame of desired thickness having upper and lower horizontal frame members attached to right and left vertical frame members, the inside of said upper and lower horizontal frame members including:

longitudinal recesses, cover plates over said recesses, guide slots along said cover plates including at least one enlarged opening therewith, first vertical supports each of thickness less than the thickness of said frame retained within recesses along each of the inside vertical members of said frame and horizontally movable from said recess to a position inside said frame of exposing a frontal width X;

at least one second vertical support of thickness less than the thickness of said frame and of frontal width no greater than 2X, said second support vertically positioned to substantially divide the space horizontally between said first vertical supports, said second support being movable horizontally either side of said division line a distance equal to the width of said second support;

each of said second vertical supports including at the upper and lower end, a bolt having a head of size larger than the width of said guide slot, but less than the diameter of said enlarged opening; and a plurality of panels to substantially fill each horizontally divided space inside said frame, each of said panels having grooves hidden between front and back sides of said panel along each vertical edge, said grooves of thickness slightly larger than the thickness of said support members and of frontal width no less than the frontal width of said second supports.

23. The wall of claim 22 including upper and lower transverse wall brackets connectable to said guie slots, a transverse wall connectable to said brackets.

24. A free-standing vertical divider wall comprising:

a quadrilateral frame of desired thickness having upper and lower horizontal frame members attached to right and left vertical frame members;

first vertical supports each of thickness less than the thickness of said frame retained within recesses along each of the inside vertical members of said frame and horizontally movable from said recess to a position inside said frame of exposing a frontal width X;

at least one second vertical support of thickness less than the thickness of said frame and of frontal width no greater than 2X, said second support vertically positioned to substantially divide the space horizontally between said first vertical supports, said second support being movable horizontally either side of said division line a distance equal to the width of said second support;

a plurality of panels to substantially fill each horizontally divided space inside said frame, each of said panels having grooves hidden between front and back sides of said panel along each vertical edge, said grooves of thickness slightly larger than the thickness of said support members and of frontal width no less than the frontal width of said second supports; said panels including grooves along their horizontal edges, a fabric covering for said panel, said covering larger than the size of said panel and including drawstring means in the peripheral edge of said covering, means within the said horizontal edge grooves to removably retain the ends of said drawstring.

25. A free-standing vertical divider wall comprising:

a quadrilateral frame of desired thickness having upper and lower horizontal frame members attached to right and left vertical frame members to define a panel receiving locus;

a plurality of panels being disposed in abutting lateral juxtaposition with each other and said vertical frame members substantially to fill said panel receiving locus and present front and rear surfaces;

means presented from said vertical frame members securingly to engage said panels;

said juxtaposed panels having abutting, vertical edges with opposed grooves hidden between the front and rear surfaces of said panels;

a vertical support having finite lateral width and being received within said opposed grooves to support said panels and being itself supported from the upper and lower horizontal frame members for movement laterally of the panel receiving locus within said frame;

said panels having horizontal upper and lower edges; said horizontal edges abutting the corresponding horizontal frame members to provide a normally indiscernable slot therebetween by which access can be gained selectively to move said vertical support with respect to said opposed grooves;

the groove within at least the edge of one said panel having a lateral depth at least equal to the finite lateral width of said vertical support.

26. A free standing vertical divider wall comprising:

a frame of desired thickness defining a panel receiving space;

support members, each of thickness less than the thickness of said frame, and extenable into the space along each of the inside vertical sections of said frame; said support members having a plurality of equally spaced apertures along their frontal width;

said space inside said frame for said panel having grooves hidden between front and back sides of said panel along each vertical edge, said grooves of thickness slightly larger than the thickness of said support members and of frontal width no less than the frontal width of said support members;

a resilient pad around the outermost peripheral edges of said panel and a decorative covering about said panel and pad whereby when in place, with each panel substantially filling said space, said support members and apertures are not in view yet access is available to said support members or to said apertures by resilient compression of the outer periphery of said pad.

27. A free standing vertical divider wall comprising:

a frame having horizontal and vertical sections of desired thickness defining a panel receiving space;

first support members, each of thickness less than the thickness of said frame, and extendable into the space along each of the inside vertical sections of said frame; said support members having a plurality of equally spaced apertures along their frontal width;

a second support member, of thickness less than the thickness of said frame, vertically positioned between said horizontal sections to substantially divide the space horizontally between said first supports, said first and second support members having a plurality of spaced apertures along their frontal width, a panel for each horizontally divided space inside said frame, each of said panels having grooves hidden between front and back sides of said panel along each vertical edge, said grooves of thickness slightly larger than the thickness of said support members and of frontal width no less than the frontal width of supports, a resilient pad around the outermost peripheral edges of each of said panels and a covering about said panel and pad whereby when in place, with each panel substantially filling each divided space, said support members and apertures are not in view yet access is available to said support members or to said apertures by resilient compression of the outer periphery of said pad.

28. In a vertical divider wall having a basic frame, vertical support members of thickness less than the thickness of said frame positionable within said receiving space to define a panel receiving space, said support members having a plurality of equally spaced apertures along their frontal width, the improvement comprising:

a panel for each horizontally divided space inside said frame, each panel having grooves hidden between front and back sides of said panel along each vertical edge, said grooves of thickness slightly larger than the thickness of said support members and of frontal width no less than the frontal width of supports, a resilient pad around the outermost peripheral edges of each of said panels and a covering about said panel and pad whereby when in place, with each panel substantially filling each divided space, said support members and apertures are not in view yet access is available to said support members or to said apertures by resilient compression of the outer periphery of said pad.

* * * * *

UNITED STATES PATENT AND TRADEMARK OFFICE

CERTIFICATE OF CORRECTION

PATENT NO. : 4,031,675

DATED : June 28, 1977

INVENTOR(S) : Raymond P. Roberts, Sven Arthur John Nilson, Jr.

It is certified that error appears in the above-identified patent and that said Letters Patent are hereby corrected as shown below:

| Column | Line | Change |
|---|---|---|
| 14 | 18 | after "frame" insert --to define a panel receiving space-- |
| 14 | 21 | cancel "to define a panel receiving space" |

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*